United States Patent [19]

Anderson

[11] 3,987,334

[45] Oct. 19, 1976

[54] INTEGRALLY BALLASTED ELECTRODELESS FLUORESCENT LAMP

[75] Inventor: John M. Anderson, Scotia, N.Y.

[73] Assignee: General Electric Company, Schenectady, N.Y.

[22] Filed: Dec. 18, 1975

[21] Appl. No.: 642,143

Related U.S. Application Data

[63] Continuation-in-part of Ser. No. 542,376, Jan. 20, 1975, abandoned.

[52] U.S. Cl. ..... 315/57; 313/45; 313/46; 313/491; 313/493; 315/248; 315/276; 315/348

[51] Int. Cl.[2] ..... H05B 41/24

[58] Field of Search ..... 315/57, 70, 248, 276, 315/348, DIG. 2, DIG. 5, DIG. 7; 313/485, 486, 487, 488, 489, 490, 491, 492, 493, 45, 46

[56] References Cited

UNITED STATES PATENTS

| | | | |
|---|---|---|---|
| 966,204 | 8/1910 | Hewitt | 315/248 |
| 2,030,957 | 2/1936 | Bethenod et al. | 315/248 |
| 2,118,452 | 5/1938 | Lebel | 315/248 |
| 3,500,118 | 3/1970 | Anderson | 315/57 |
| 3,521,120 | 7/1970 | Anderson | 315/57 |
| 3,551,742 | 12/1970 | Gruzdev et al. | 315/248 |
| 3,611,009 | 10/1971 | McNeil | 315/57 |

*Primary Examiner*—Alfred E. Smith
*Assistant Examiner*—Tommy P. Chin
*Attorney, Agent, or Firm*—Jack E. Haken; Joseph T. Cohen; Jerome C. Squillaro

[57] ABSTRACT

An electrodeless fluorescent lamp, suitable for substitution in place of existing incandescent lamps, comprises a gas filled toroidal envelope assembly removably mounted around a cylindrical ballast assembly. The ballast supplies radio frequency energy which induces electric current flow within the envelope and stimulates the emission of visible light. A toroidal transformer, which may have a ferrite core, is contained within a constriction on the envelope toroid and couples the energy to the gas. Heat generated within the envelope and transformer is conducted through the ballast to a radiator. The heated surfaces of the ballast and envelope form a chimney which induces air flow over the radiator.

29 Claims, 7 Drawing Figures

Fig. 1
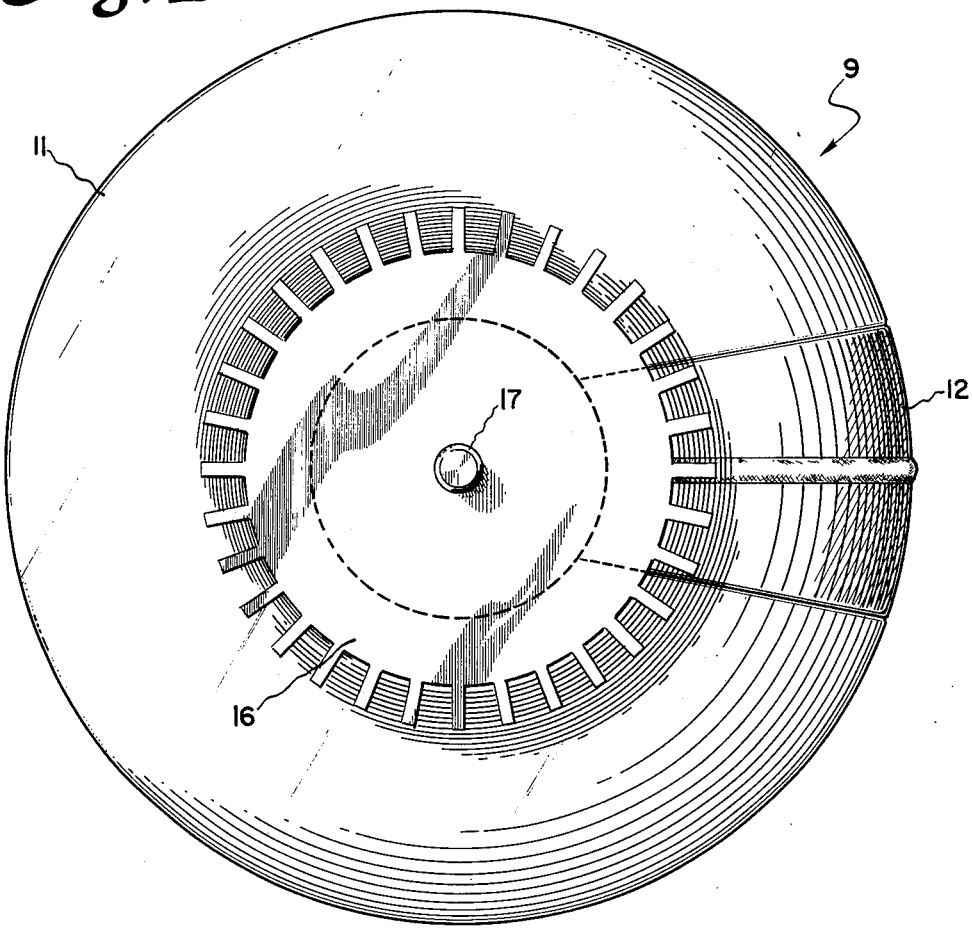
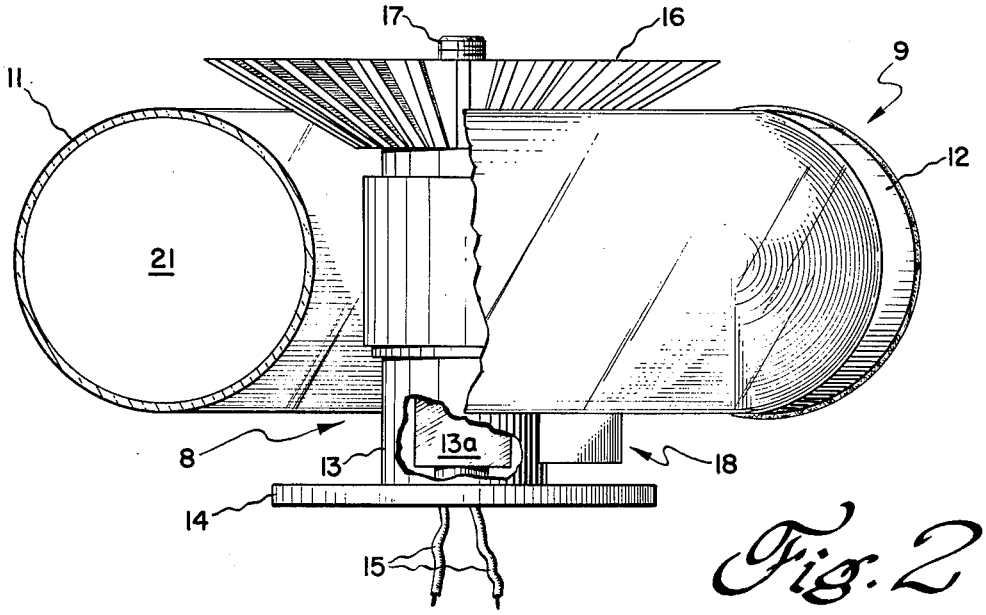
Fig. 2

Fig. 3
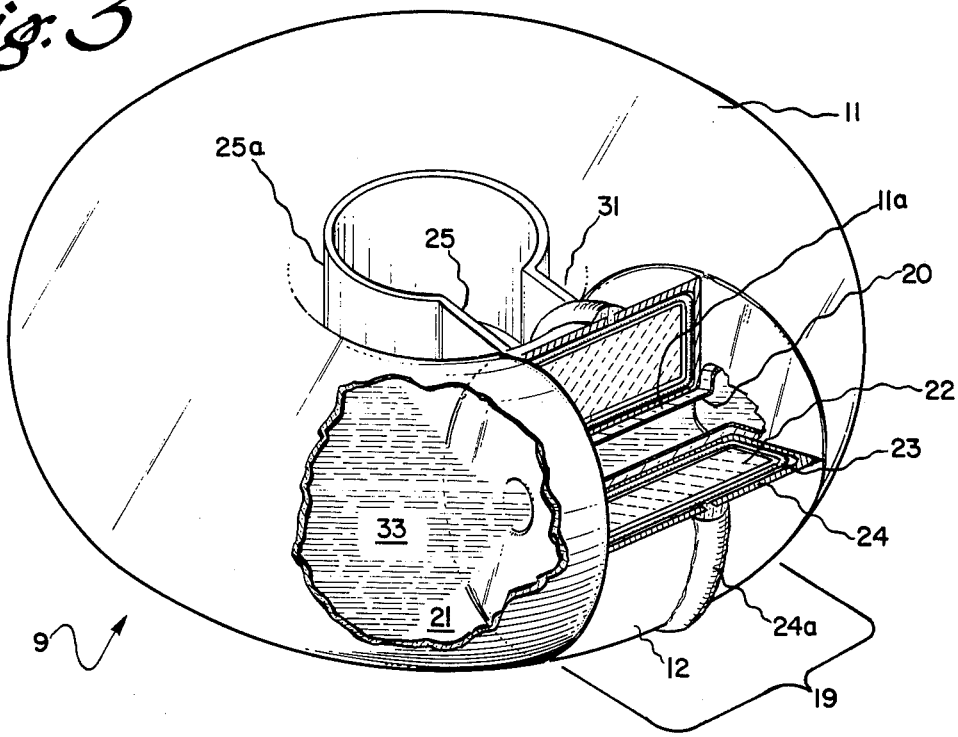
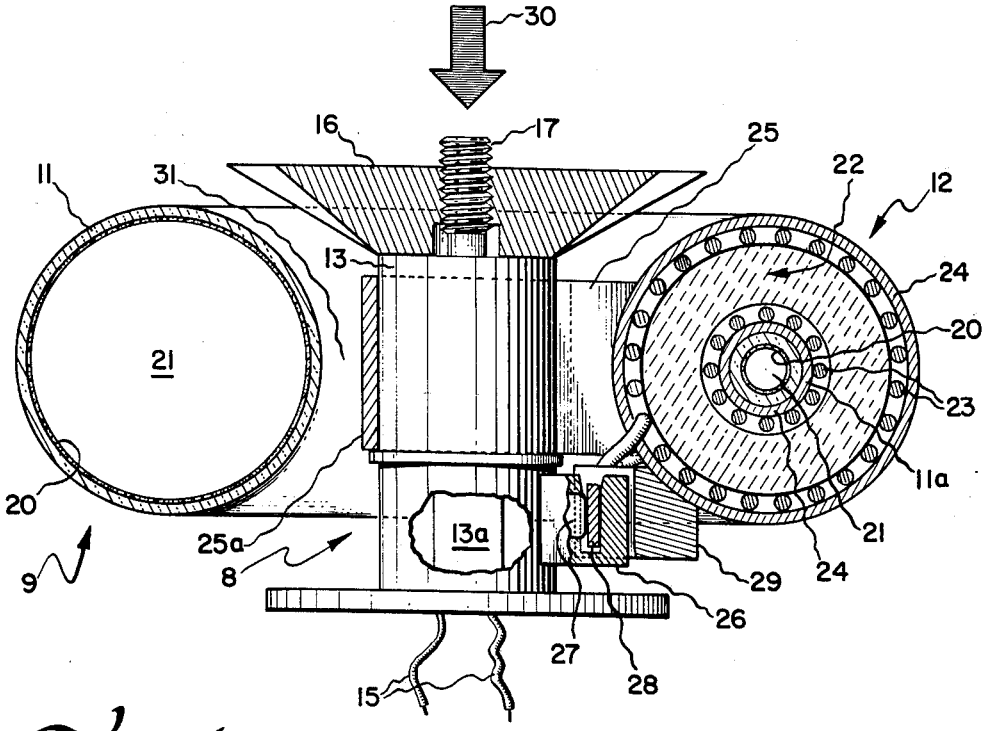
Fig. 4

Fig. 5
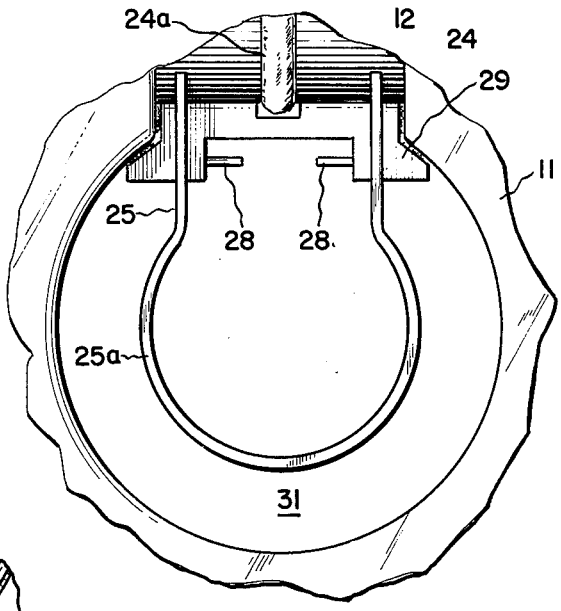
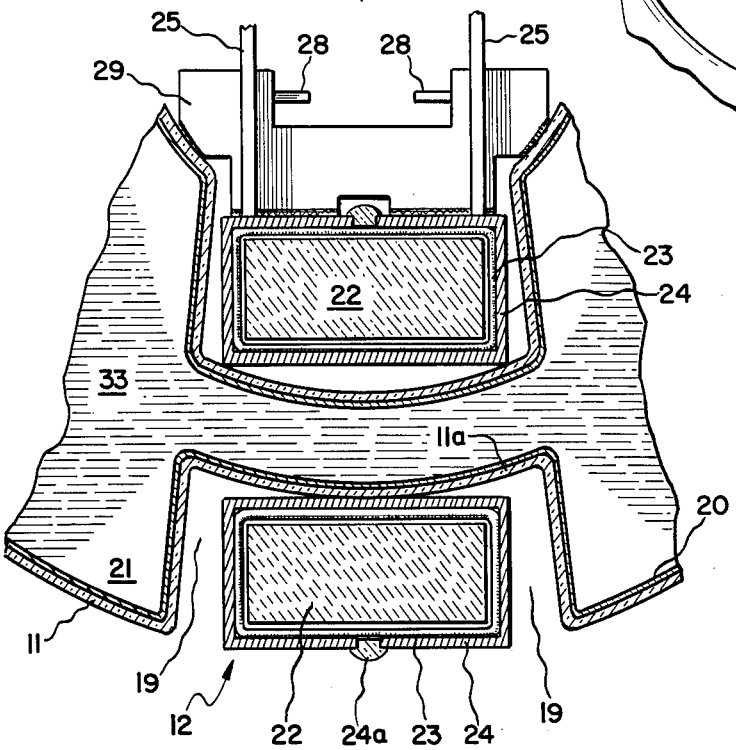
Fig. 6
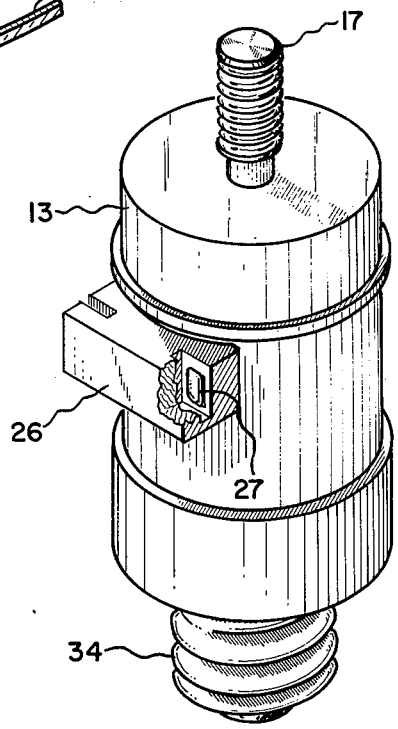
Fig. 7

INTEGRALLY BALLASTED ELECTRODELESS FLUORESCENT LAMP

CROSS REFERENCE, CONCURRENT APPLICATION, AND INCORPORATION BY REFERENCE

This is a continuation-in-part of U.S. Pat. application Ser. No. 542,376, filed Jan. 20, 1975 now abandoned. Portions of the matter herein disclosed are the subject of claims in concurrently filed United States patent applications Ser. No. (642,142), John M. Anderson; Ser. No. (642,148), John M. Anderson; and Ser. No. (642,156), Homer H. Glascock and John M. Anderson, all of said patent applications having been assigned to the assignee of this patent application. The principles of operation of induction ionized fluorescent lamps using ferrite core transformers are disclosed in U.S. Pat. Nos. 3,500,118, issued Mar. 10, 1970 and 3,521,120 issued July 21, 1970 to John M. Anderson.

The above-mentioned disclosures are hereby incorporated by reference into this patent application.

BACKGROUND OF THE INVENTION

This invention relates to fluorescent lamps which are adapted as direct replacements for existing incandescent lamps. More specifically, this invention concerns fluorescent lamps wherein ionization is induced by a transformer linking the lamp envelope.

The incandescent lamp is the primary luminary for household and residential lighting. This lamp generally includes an incandescent filament within a predetermined nonoxidizing atmosphere which is contained within a tear drop shaped envelope and mounted, for example, within an Edison-type base which is screwed into a permanent fixture or into a movable socket.

Despite their widespread use, incandescent lamps are relatively inefficient, producing only 15–17 lumens per watt of input power and have relatively short, unpredictable service lives. Fluorescent lamps, which have efficiencies as high as 80 lumens per watt, provide an attractive alternative to incandescent lighting. Conventional fluorescent lamps, however, require a long tubular envelope which, together with the need for auxiliary ballasting equipment, has somewhat limited their acceptance in the home lighting market. Increased residential use of fluorescent illumination, with attendant savings of energy, can be achieved from the development of fluorescent lamps which are directly compatible with existing sockets and incandescent lamp fixtures.

The electric lamp technology has long sought electric discharge devices which produce visible light for general illumination purposes without the utilization of electrodes as the foot-points of a glow or arc discharge. Although the principles of electrodeless discharge lamps are very old, such lamps have always included the concept of coupling electrical energy into an hermetically sealed gas-containing envelope by means of a ferromagnetic or air core transformer to avoid the use of electrodes. Such devices have never proved practical or commercially feasible, because it has been impossible to achieve any reasonable efficiency of light emission upon the utilization of iron or air core transformers because of core losses, among other factors.

It has been proposed in the prior art to excite electrodeless gaseous discharge lamps using electromagnetic induction to transfer electric energy into the discharge vessel. Experiments along this line disclose that heretofore such means have been highly impracticable. If an air core transformer is utilized, the inefficiency of the coupling procedure required to achieve a reasonable power input to the gaseous discharge results in a loss of power by radiation which is prohibitive, and which may be dangerous. Accordingly, such devices have never been successfully operated for useful periods at any reasonable efficiency.

Another alternative that has been proposed in the prior art is the utilization of an iron or ferromagnetic cores. Such cores, however, may be utilized only on very low frequencies in order that eddy current heating of the iron does not cause core failure. Utilizing alternating current, it is exceedingly difficult to operate an iron core transformer for the purpose of transferring energy of this nature at frequencies in excess of 5 or 10 kilohertz per second. Based upon experimental and calculated results obtained in this laboratory, it has been determined that for an iron core transformer operating at 50 kHz, core power losses are in the range of approximately 80 to 90 percent. Accordingly, from the foregoing it may readily be appreciated that air core and iron core transformers are, from a practical point of view, inoperative at the high radio frequency levels that are necessary for efficient operation of gaseous discharge lamps in accord with this invention.

In my prior U.S. Pat. Nos. 3,500,118 and 3,521,120, I disclosed designs for fluorescent lamps which utilize a magnetically induced radio frequency electric field to ionize gaseous radiating medium. The elimination of discharge electrodes within these lamp envelopes substantially increases their life and allows lamp shapes more compatible with home lighting needs.

My U.S. Pat. No. 3,500,118, issued Mar. 10, 1970 describes an improved, electrodeless fluorescent lamp having a radio frequency power supply. This design was bulky, comprising a large tubular discharge ring, several ferrite cores, and a remotely mounted power supply which made it unsuitable for use in many industrial and residential applications.

My later U.S. Pat. No. 3,521,120 issued July 21, 1970 described a more compact lamp configuration. However, this lamp maintained a high frequency magnetic field in the air surrounding the envelope and thus constituted an unacceptable source of electromagnetic radiation and interference.

SUMMARY OF THE INVENTION

Briefly stated, in accord with the present invention, I provide a phosphor coated, gas-filled, toroidal envelope which forms the secondary winding of a high frequency transformer. An annular transformer core with primary windings attached is contained within a constriction of the envelope's minor diameter. A radio frequency power supply is mounted in a cylindrical container along with toroid's major axis. Metallic spring contacts transfer radio frequency energy from the power supply to the transformer while allowing heat transfer from the transformer to a radiator mounted atop the power supply. In this configuration the lamp envelope forms a chimney which directs air flow over the radiator.

It is, therefore, an object of this invention to provide a compact electrodeless fluorescent lamp having a highly efficient, integral heat radiating structure.

It is a further object of this inventin to provide a compact, electrodeless, fluorescent lamp wherein the magnetic induction field is substantially contained within ferrite material.

Still another object of this invention is to provide an electrodeless fluorescent lamp having a separately replaceable ballast and a glass envelope integrated with a single, closed, toroidal transformer core.

BRIEF DESCRIPTION OF THE DRAWINGS

The novel features believed to be characteristic of the present invention are set forth in the appended claims. The invention itself, together with further objects and advantages thereof, may be best understood with reference to the following detailed description, taken in connection with the appended drawings in which:

FIG. 1 is a top view of an embodiment of this lamp which is designed for flange mounting on an electrical distribution box.

FIG. 2 is a side view of the lamp embodiment of FIG. 1.

FIG. 3 is a removable illuminating assembly for use with these lamp embodiments.

FIG. 4 is a sectional view through the illuminating assembly.

FIG. 5 is a bottom view of the illuminating assembly showing the ballast mounting components.

FIG. 6 is a partial top sectional view through the transformer core and lamp envelope.

FIG. 7 is an alternate embodiment of the lamp ballast assembly which is designed for connection with a conventional Edison screw socket.

DESCRIPTION OF THE PREFERRED EMBODIMENT

My concurrently filed United States patent applications, Ser. No. (642,142) and Ser. No. (642,156), and my issued U.S. Pat. Nos. 3,500,118 and 3,521,120 describe a class of fluorescent lamps wherein radiation from a gaseous medium is induced by a radio frequency magnetic field acting within a high permeability, low loss magnetic material. The principles of operation of these lamps and suitable electrical circuits for generating the radio frequency power required for such operation are described in the above-mentioned patents and applications.

FIGS. 1 and 2 illustrate the external characteristics of a lamp embodiment designed for flange mounting on an electrical distribution box. A phosphor coated toroidal glass envelope 11, with an integrally mounted transformer 12, form a removal illuminating assembly 9. A solid state ballast 8 contains electrical circuits 13*a* for converting power line energy to radio frequency power required by the lamp. These circuits, in a cylindrical can 13 are centrally positioned within the envelope toroid 11. Flange 14 facilitates mounting the ballast on an electrical distribution box (not shown) wherein the connections are made through wires 15. Heat generated within the transformer 12 and ballast 8 is conducted along the can 13 to a radiator 16 for dissipation in the surrounding air. The radiator is threaded onto a bolt 17 and also serves to secure the ballast 8 to the illuminating assembly 9. A socket assembly 18 serves to provide thermal and electrical connections between the ballast 8 and the transformer 12.

The illuminating assembly, FIG. 3, comprises a generally toroidal glass envelope 11 with an integrally mounted transformer assembly 12 and ballast socket (not shown). The envelope may be formed of conventional lamp glass and is internally coated with any of the phosphors known to the fluorescent lamp art, for example, calcium halophosphates or calcium fluorophosphates. The interior of the envelope contains a fluorescent lamp fill gas 21, typically a mixture of a rare gas (e.g., krypton) and mercury vapor or cadmium vapor at a pressure of approximately 1 torr or less.[1] These phosphors are capable of absorbing the ultraviolet radiation of the gas which is generally peaked at about 2537 A and, upon stimulation thereby, emitting radiation within the visible spectrum to produce a highly efficient and pleasing light output. In this embodiment of the invention, the fill gas is not relied upon to produce substantial light emission, but rather, to produce radiation which causes light to be emitted from a luminescent phosphor. This, in a manner well known to the art, allows for a relatively efficient operation. In a typical 3300 lumen lamp, the envelope 11 has an outside major diameter of 20 cm., an inner major diameter of 5 cm., and a minor diameter of 7.5 cm. The envelope 11 is constricted over a small segment of its circumference to provide a groove 19 for mounting the transformer assembly. The depth of the groove 19 and dimensions of the transformer 12 are selected so that the assembled structure forms a toroid of substantially constant minor radius. In the above-described 3300 lumen lamp the constriction has a diameter of approximately 2.5 cm.

The construction of the ballast socket and transformer assembly is illustrated in FIGS. 3 and 4. Lamp envelope 11, internally coated with the phosphor 20 and filled with the gas 21, is constricted 11a along a transformer groove 19. A toroidal magnetic core 22 is wrapped with a primary winding 23 and contained within an annular, metal transformer can 24. The assembly of the core 22, winding 23, and transformer can 24 forms the transformer assembly 12 of FIG. 3, which links the envelope 11 and fills the groove 19. A heat conducting strap 25 is bonded to the metal can 24. The strap 25 forms a ring 25*a* which surrounds and contacts the ballast assembly 8 forming a path whereby heat produced in the core 22 and winding 23 may be conducted to the ballast can 13 and thence to the radiator 16. The metal strap 25 is constructed of elastic material and mechanically biased to provide a tight, sliding fit with the ballast can 13. A dielectric block, 26 mounted on the side of a ballast assembly 8, supports two blade contacts 27 which are electrically connected to the output of the electrical circuits 13a forming the radio frequency power supply. Contacts 27 slidably engage transformer contacts 28 which are anchored to the metal transformer can 24 with a second dielectric block 29.

[1] Unless otherwise noted, all pressures herein stated are measured at room temperature.

The radiator 16 may be removed from the ballast assembly 8 by unscrewing the radiator from bolt 17. The ballast assembly 8 with flange 14 and wires 15 attached may then be slidably removed by withdrawing the ballast assembly from the envelope in the direction indicated by arrow 30 in FIG. 4. Upon reinsertion of the ballast assembly 8, strap 25 slidably re-engages the ballast can 13 providing thermal contact while blade contacts 27 slidably engage transformer contacts 28 providing an electrical connection from the electrical circuits 13*a* to the transformer primary winding 23.

The envelope assembly is secured to the ballast by reason of the bias force applied by metal strap 25.

Accidental disengagement is prevented by radiator 16 which has a maximum diameter greater than the inner major diameter of the envelope assembly 9.

Heat produced within the envelope 11, the transformer assembly 12, and the ballast assembly 13 is conducted to radiator 16 where it is dissipated by thermal conduction and convection to the atmosphere. The flow of air over the radiator 16 (which may have a finned structure) is enhanced by a chimney effect, produced when air heated by the exterior surfaces of the ballast can 13 and envelope 11, rises and flows through the gap 31 between the ballast assembly 8 and the envelope assembly 9.

The general construction of an envelope assembly socket is illustrated in FIG. 5, which is a partial bottom view of the envelope assembly with the ballast assembly removed. The second dielectric block 29 is mounted on the transformer assembly 12 within the inner diameter of the toroidal lamp envelope 11. Dielectric block 29 supports the transformer contacts 28 which are adapted for slidably contacting the ballast blade contacts 27 of FIG. 2. The metal spring strap 25 forms a coaxial circle within the toroidal envelope 11 and is adapted for slidable insertion of the ballast assembly 8 of FIG. 4.

Details of the construction of the transformer assembly 12 of FIG. 3 are illustrated in the sectional view of FIG. 6. The transformer assembly 12 lies within and substantially fills the groove 19 produced by the construction 11*a* in the glass envelope 11. The transformer comprises a toroidal magnetic core 22 linked by a primary winding 23. The core may, if desired, be split into two or more mating sections to facilitate assembly of the lamp structure. A metal transformer can 24 covers the core and winding providing physical protection against abrasion as well as a heat conduction path to the metal strap (not shown). A dielectric (which may be glass) filled gap 24*a* in the metal can 24 surrounds the major diameter of the transformer assembly. If this gap were not present the metal can 24 would function as a single shorted turn winding on the transformer and would effectively prevent operation of the lamp. The metal can 24 may be copper, aluminum, or any other metal having good thermal conduction properties. A small radio frequency voltage exists across this gap during lamp operation. It may, therefore, be desirable to insulate the transformer can with a deielectric coating (not shown) or to position the gap on the inner circumference of the can where accidental contact will be less likely to occur.

Dielectric block 29, which supports envelope contacts 28, is bonded to the metal transformer can 24 and the envelope 11 and serves to support an electrical conduction path from the contacts 32 to the primary winding.

The ballast electrical circuits 13*a* provide radio frequency power for the transformer and functions to stabilize the plasma discharge. Present day core heating and component cost considerations limit operation of the power supply frequency range from approximately 25 kHz to approximately 1 MHz with a preferred operating frequency of approximately 50 kHz.

Obviously, the choice of core material is an important factor in enabling operation of this lamp. Whereas prior art literature has described similar lamp configurations having air or iron cores, I have determined that the loss inherent in the operation of these prior art cores preclude the construction of a practical lamp. As indicated in the referenced patents, ferrite or similar material must be chosen to provide high permeability and low internal heat loss at the operating frequency. As is well known to the art, a ferrite is a ceramic-like material which shos ferrimagnetic properties and usually exhibits a spinel structure having a cubic crystal lattice and, for example, may have the generalized formula $Me{\cdot}Fe_2O_4$ wherein Me represents any metal.

In accord with the present invention, it is necessary that the cores utilized be of such material and configuration that the core losses are no greater than 50 percent in order that effective coupling of electromagnetic energy into the light source may be effected. Similarly, low core losses, reduce heating of the core and minimize the possibility of failure and maximize its efficiency. Preferably, core losses are maintained to less than 25 percent of total input power.

A high permeability core material is also necessary to assure adequate coupling of radio frequency energy to the gas with minimum electromagnetic radiation. A ferrite having a relative permeability of at least 2000 is preferable. Suitable ferrites are avilable having these characteristics over the frequency range from 25 kHz to 1 MHz. High frequency operation is desirable from the standpoint of minimizing ferrite losses; but the present cost of available semiconductors for use in the radio electrical circuits 13*a* limits the maximum frequency at which a practical lamp may be operated to approximately 50 kHz. Among other materials, I have found ferrite Type 8100, manufactured by the Indiana General Corp. of Keysbee, New Jersey and characterized by losses of less than 90 mw. $cm^{-3}$ for 1000 gauss peak flux density at lamp operating temperature and 50 kHz operation to be suitable for use in this lamp. Other core materials having similar low loss factors may, alternatively, be utilized. For example, a composite of powdered ferrite in polyimide resin having a permeability of at least 40 may be utilized if the ampere turns of the primary windings are proportionally increased.

The plasma 33 within the lamp envelope of this embodiment forms a toroid of approximately uniform cross section. As illustrated in FIG. 6, however, the ionized gas plasma is somewhat constricted in the area of the envelope constriction 11*a*. The loss of light output associated with this constriction is throught to be less than 5 lumens per watt and is thought to be acceptable in light of the benefits realized by this lamp configuration.

The electrical circuits 13*a* comprising the radio frequency power supply may be of any type known to the art. For example, the inverter which is more fully described in referenced U.S. Pat. No. 3,521,120 would be suitable for use with lamps operating within its power range.

FIG. 7 illustrates an alternate construction for the ballast assembly 13. In this configuration, an Edison screw base 34 replaces the flange 14 and wires 15 illustrated in FIGS. 1, 2, and 4. Lamps incorporating this ballast assembly are compatible with residential incandescent lamps and may be used as direct screw-in replacements in existing sockets.

It may, therefore, be seen that the invention provides an electrodeless fluorescent lamp assembly which is adapted for use as a direct, compatible, replacement for existing incandescent lamps and incandescent lamp fixtures. The magnetic field associated with the radio frequency induction power supply is wholly contained with the magnetic core which forms an integral component of the envelope assembly. Radio frequency electromagnetic interference associated with the induction power supply is thereby greatly reduced over prior art embodiments. The envelope and ballast assemblies form components which may be easily separated for repair or replacement. Heat transfer from the transformer and ballast assemblies is significantly increased by virtue of induced air flow over the ballast and within the toroidal envelope center.

While the invention has been described in detail herein in accord with certain preferred embodiments thereof, many modifications and changes therein may be effected by those skilled in the art. Accordingly, it is intended by the appended claims, to cover all such modifications and changes as fall within the true spirit and scope of the invention.

The invention claimed is:

1. An improved, electrodeless florescent lamp comprising;

an evacuable envelope of light-transmissive material having a generally toroidal shape, the minor diameter of said envelope being uniformly constricted along a portion of its major circumference;

an ionizable gas contained within said envelope, said gas being adapted to emit a first wavelength radiation when sustaining an electric discharge;

a luminescent phosphor coated on the inside of said envelope, said phosphor being adapted to emit visible radiation when excited by said first wavelength radiation;

toroidal, magnetic core transformer means, having high permeability and low loss at radio frequencies between approximately 25 kHz and approximately 1 MHz, encircling said envelope around said constricted portion, and adapted to induce an electric field in said ionizable gas whereby said electric discharge is produced:

radio frequency power supply means adapted to fit within the inner diameter of said envelope;

coupling means adapted to transfer radio frequency power from said radio frequency power supply means to said transformer means and to transfer heat from said transformer means to said radio frequency power supply means;

heat exchange means attached to said radio frequency power supply means adapted to transfer heat from said radio frequency power supply means to the atmosphere; and mounting means to secure said envelope to said radio frequency power supply.

2. The fluorescent lamp of claim 1 wherein said magnetic core means comprise materials having power loss factors of less than 50 percent at the lamp operating temperature and frequency.

3. The fluorescent lamp of claim 1 wherein said core means comprises ferrite.

4. The fluorescent lamp of claim 1 wherein said envelope is glass.

5. The fluorescent lamp of claim 4 wherein said envelope has an outside major diameter of approximately 20 cm., an inner major diameter of approximately 6 cm., and a minor diameter of approximately 7.5 cm.

6. The fluorescent lamp of claim 1 wherein said ionizable gas comprises a mixture of rare gas and gases selected from the group consisting of mercury vapor, cadmium vapor, and mixtures thereof.

7. The fluorescent lamp of claim 6 wherein said rare gas comprises krypton.

8. The fluorescent lamp of claim 6 wherein said ionizable gas has a pressure of approximately 1 torr.

9. The fluorescent lamp of claim 1 wherein said transformer means comprise:

a toroidal magnetic core having high permeability and low losses at radio frequencies between approximately 25 kHz and approximately 1 MHz;

a primary winding linking said toroidal core with a plurality of turns; and conductive containing means covering said core and said primary winding, said containing means having disposed therein dielectric material whereby electrical conduction through said containing means around the minor circumference of said toroidal core is prevented.

10. The fluorescent lamp of claim 9 wherein the diameter of said transformer means approximately equals the unconstricted minor diameter of said envelope.

11. The fluorescent lamp of claim 9 wherein said containing means comprise an annular can having a dielectric filled gap extending about the major circumference of said can.

12. The fluorescent lamp of claim 11 wherein said dielectric is glass.

13. The fluorescent lamp of claim 11 wherein said can is copper.

14. The fluorescent lamp of claim 11 wherein said can is aluminum.

15. The fluorescent lamp of claim 1 wherein said radio frequency power supply means comprises a right circular cylinder having first and second ends and lying coaxial to said envelope.

16. The fluorescent lamp of claim 15 wherein said first end of said cylinder comprises a flange adapted for mounting to an electrical distribution box.

17. The fluorescent lamp of claim 15 wherein said radio frequency power supply means further comprise a lamp base plug attached to said first end of said cylinder and adapted to supply energy to said radio frequency power supply means.

18. The fluorescent lamp of claim 15 wherein said heat exchange means comprise a radiator attached to said second end of said cylinder.

19. The fluorescent lamp of claim 18 wherein the structure of said radiator is adapted to preclude passage of said radiator through the center of said envelope.

20. The fluorescent lamp of claim 19 wherein said radiator is circular; having a diameter greater than the inside major diameter of said envelope.

21. The fluorescent lamp of claim 19 wherein said radio frequency power supply means further comprise:

a bolt member extending along the axis of said cylinder from said second end thereof, said radiator being threaded for engagement with said bolt, whereby said radio frequency power supply means is retained within said envelope.

22. The fluorescent lamp of claim 18 wherein said radiator is finned.

23. The fluorescent lamp of claim 15 wherein said coupling means comprise a thermally conductive strap having a generally annular shape, bonded to said transformer means and adapted for slidably engaging said radio frequency power supply means, whereby heat is transferred from said transformer means to said radio frequency power supply means.

24. The fluorescent lamp of claim 23 wherein said strap comprises elastic material adapted for applying an inwardly directed bias force against said radio frequency power supply means.

25. The fluorescent lamp of claim 24 wherein said coupling means further comprise:

a first dielectric block fastened to said power supply means;

a first plurality of metallic electrical contacts disposed on said first dielectric block;

a second dielectric block fastened to said transformer means and extending therefrom toward the major axis of said envelope; and a second plurality of metallic electrical contacts disposed on said second dielectric block, said second plurality of contacts being adapted for slidable engagement with said first plurality of contacts, whereby power from said radio frequency power supply means is tranferred to said transformer means.

26. An improved electrodeless fluorescent lamp comprising:

a substantially toroidal, phosphor coated, light-transmissive envelope assembly containing a gas and having an integrally mounted transformer for exciting said gas by the process of radio frequency electric induction, said gas being adapted to emit radiation at a first wavelength radiation and said phosphor being adapted to emit visible light when excited by said first wavelength radiation;

a radio frequency power supply comprising heat radiating means and means for producing radio frequency energy, said radio frequency power supply being of generally cylindrical shape with an outside diameter less than the inside major diameter of said envelope, removably mounted within the inner major diameter of said envelope;

means for removably connecting said power supply to said envelope, said means being adapted to transfer heat from said envelope to said power supply and to transfer said radio frequency energy from said power supply to said transformer.

27. The fluorescent lamp of claim 26 further comprising a lamp base plug attached to said power supply and adapted for receipt of energy from existing lamp sockets.

28. The fluorescent lamp of claim 27 wherein said lamp base plug is an Edison screw plug.

29. An improved electrodeless fluorescent lamp comprising:

a substantially toroidal, gas filled, envelope assembly having means for inducing a radio frequency electric field within said gas whereby visible light is emitted from said envelope;

a heat dissipating element mounted within the inner major diameter of said envelope and adapted to permit air flow between said envelope and said heat dissipating element;

means for mounting said envelope whereby the major axis of said envelope is maintained substantially vertical; and means for coducting heat generated in said envelope from said envelope to said heat dissipating element, whereby air is induced to flow between said envelope and said heat dissipating element and heat is removed from said element to said air.

* * * * *